United States Patent [19]

Hagelberg

[11] 3,936,122

[45] Feb. 3, 1976

[54] SAFETY DEVICE IN ELECTRICAL CONNECTION DEVICES

[75] Inventor: Anders Torvald Sverker Hagelberg, Molnlycke, Sweden

[73] Assignee: Bengt Petersson New Products Investment AB, Sweden

[22] Filed: Aug. 29, 1974

[21] Appl. No.: 501,820

[30] Foreign Application Priority Data

Aug. 30, 1973 Sweden ..... 73117764

[52] U.S. Cl. ..... 339/41; 339/176 L; 339/180

[51] Int. Cl.² ..... H01R 13/44

[58] Field of Search ..... 339/40, 41, 111, 176 L, 339/180

[56] References Cited

UNITED STATES PATENTS

| | | | |
|---|---|---|---|
| 2,161,774 | 6/1939 | Cooke | 339/180 |
| 2,181,050 | 11/1939 | Evans | 339/40 |
| 2,688,669 | 9/1954 | Quill | 339/180 |
| 3,363,215 | 1/1968 | Smith | 339/41 |
| 3,812,446 | 5/1974 | Sinclair | 339/41 |

*Primary Examiner*—Roy Lake
*Assistant Examiner*—Mark S. Bicks
*Attorney, Agent, or Firm*—Toren, McGeady and Stanger

[57] ABSTRACT

The present invention relates to a safety device in electrical connection devices, especially lamp-holders, comprising a number of contact parts designed to rest against an object arranged to be connected to the connection device, for example a light bulb socket, and a number of elements arranged to be connected to the electric leads of a cable, whereby the contact parts are at a distance from the respective connector elements and are arranged by means of being pushed in by a spring function to achieve contact with these during connection of said object to the device. According to the invention the device is provided with at least one insulating element, forced to be between the contact parts and the respective connector elements and thereby prevent contact between these when said object is removed from the connection device, and simultaneously arranged to be moved by means of the object during its connection to a position in which the contact parts and the respective connector elements are free from the insulating element to be pressed against each other by means of the object by its connection.

7 Claims, 10 Drawing Figures

SAFETY DEVICE IN ELECTRICAL CONNECTION DEVICES

SUMMARY OF THE INVENTION

The present invention relates to a safety device in electrical connection devices, especially lamp-holders, comprising a number of contact parts designed to rest against an object arranged to be connected to the connection device, for example a light bulb socket, and a number of elements arranged to be connected to the electric leads of a cable, whereby the contact parts are at a distance from the respective connector elements and are arranged by means of being pushed in by a spring function to achieve contact with these during connection of said object to the device.

Safety devices intended to prevent involuntary contact with current carrying parts are common in for example wall sockets. Connection devices of this type are however relatively easy to protect as the live parts are accessible only through small openings which can be provided with flaps or shutters or similar. In the case of contact fittings with larger openings it has however not proved possible to achieve practical, automatic safe-guards against involuntary contact. An example of the type of contact fitting with a great risk of involuntary contact is that of normal lamp-sockets. As long as a lamp is screwed in the risk of involuntary contact is generally small, whereas if on the other hand there is no lamp screwed into the lamp-socket the live parts are accessible through a wide opening.

The object of the present invention is to achieve a safety device that creates a safe-guard against involuntary contact even in the case of such connection devices which are showing a large opening, especially lamp-holders.

The purpose of the invention is achieved by constructing the safety device that at least one insulating element is forced to be between the contact parts and the respective connector elements and thereby prevent contact between these when the said object is removed from the connection device and simultaneously arranged to be moved by means of the object during its connection to a position in which the contact parts and the respective connector elements are free from the insulating element to be pressed against each other by means of the object by its connection.

BRIEF DESCRIPTION OF THE DRAWING

In the accompanying drawings three embodiments of the invention are shown, with

DETAILED DESCRIPTION OF THE INVENTION

Figure 1:
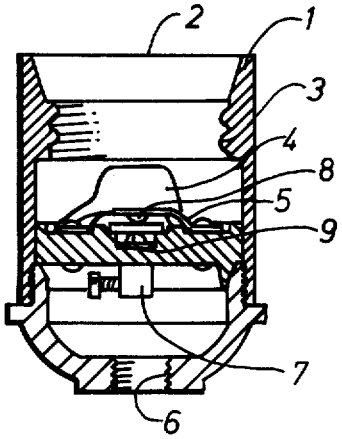
FIGS. 1 and 2 showing a lamp-holder in two central elevations perpendicular to each other.

In accordance with the figures the lamp-holder shows a casing 1 with an opening 2 and a thread 3 for screwing in the socket of a light bulb. Inside the thread 3 there are two spring contact sheet metal shields, one side shield 4 and one central shield 5, which make contact with the current collecting portion of the bulb when it is screwed in. Right opposite the opening 2 there is a hole 6 for a flex that can be joined to connector clips 7. In the usual type of lampholders the contact shields are connected directly to the connector clips, possibly via a switch. In the case of the lamp-holder according to the invention however the contact shields 4, 5 are not connected directly to the connector clips 7, but instead only make contact after overcoming the spring resistance built in to the shields and pressed with sections 8 against sections 9 which are in direct contact with the connector clips 7. Such a contact is however prevented by a bridge 10 made of insulating material forced by means of the tension in a spring section to take up a position between the contact parts 8 and 9.

When there is no bulb screwed into the lamp-socket the contact shields 4 and 5 thus are forced to take up a position with their contact parts 8 at a distance from the contact parts 9 of the connector clips 7, and they are thus already out of contact with the live leads. In addition the insulating bridge 10 is between the contact parts 8 and 9 and is retained in this intermediate position by the spring section 11. This prevents contact between the contact parts 8 and 9 even if one of the contact shields 4, 5 were subjected to pressure.

Figure 2:
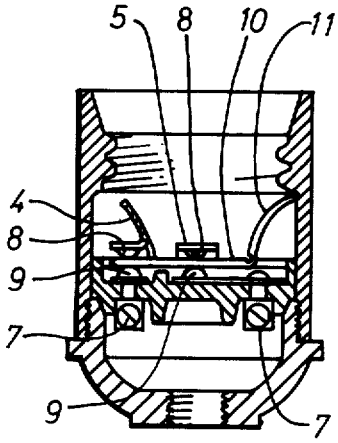
Figure 3:
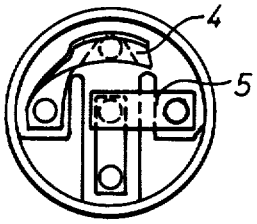
FIG. 3 shows a bottom plate in the lamp-socket in front view elevation and FIG. 4 shows a detail in the lamp-socket in perspective, while FIGS. 5 and 6 demonstrate the function of the embodiment in FIGS. 1–4.
Figure 4:
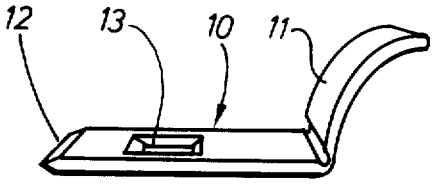

If however a light bulb is screwed with its socket down in the thread 3, the edge of the socket will first meet the part 11, thereby pushing the bridge 10 across to the right in FIG. 2; with this the edge of the bridge is freed from its position between the side shield 4 and its connector clip. Simultaneously a hole in the bridge 10 will be right opposite the central contact 5. As the bulb is screwed further in, its respective current collectors will press the contact shields 4, 5 towards their connector clips 7, and in this position the bridge 10 is no hindrance, instead at the lowest position the bulb socket has ensured contact between the contact parts 8 and 9, and the bulb obtains contact with the live lead.

When the bulb is screwed out, the parts return to their starting positions. In order to make involuntary contact with any live parts in a lamp-holder without a bulb screwed in, one would thus first have to push the bridge 10 to its non-active position and then press down the contact shield opposite a connector clip 7 that is connected to an electric conductor. For this to take place is all but beyond the realms of probability.

Figure 5:
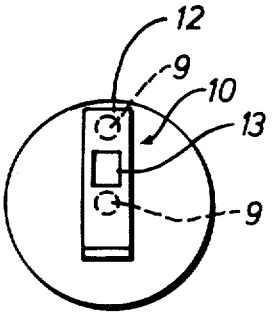
Figure 6:
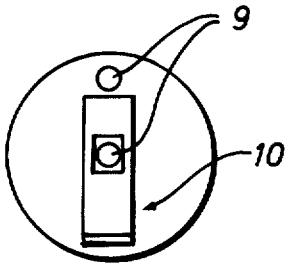

FIGS. 5, 6 show how the bridge 10 takes up its various positions in relation to the contact parts 8, 9 in safeguarded and contact position respectively.

The basic idea of the invention is thus that the respective parts that are to conduct current to the connecting part, in this case the light bulb, are not directly connected to the current carrying lead but instead achieve this connection only by being pushed in against a spring force, which in turn is prevented by means of a device designed to be pushed aside by the connecting part. This principle can of course be applied to other electrical contact devices than lamp-holders and can also be applied irrespective of the number of contacting terminals.

Figure 7:
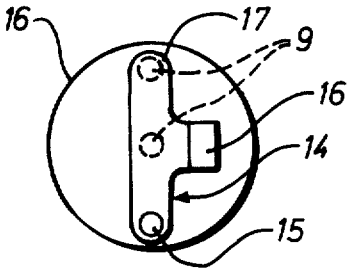
FIGS. 7, 8 show the second embodiment in two positions.
Figure 8:
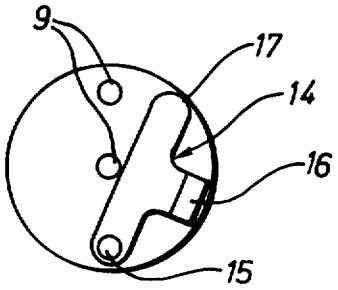

As to design there is a wide scope of variation, especially in the matter of the part that is to prevent the contact shields from being pushed in. In the example cited a sliding bridge is used, but in accordance with FIGS. 7 and 8 a hinged bridge 14, mounted on a axis 15, can be used. The bridge 14 is affected by a spring not shown and is forced to take up the position shown in FIG. 7, covering the contact parts 9. When a bulb is screwed in the edge of its socket meets a projecting device 16 turning the bridge 14 on the axis 15 so that the contact parts 9 are bared and the current collectors can be pressed down against the live contact parts. If instead the projecting device is placed at the end 17 of the bridge 14 and is allowed to drag against the edge of the bulb socket, instead of compressive force the friction so arising will be used to swing the bridge. Thus the bridge through this friction will be turned clockwise when the bulb is screwed in thereby exposing the contact parts 9, and anti-clockwise when the bulb is screwed out again covering the contact parts 9. The spring mentioned thus only needs to be contrived to keep the contact bridge in a covering position, when there is no bulb in the lamp-holder, while the spring does not need to be arranged to return the bridge to a covering position. This ensures an even greater guarantee that the bridge returns to its position even if there should be deformations or burns on the contact parts.

Figure 9:
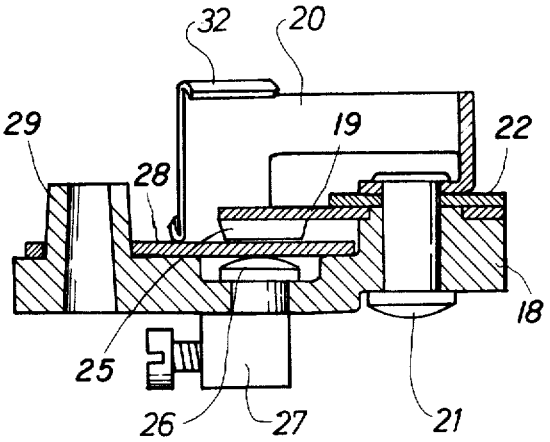
FIGS. 9, 10 show a bottom plate of the third embodiment in section and front view elevation respectively.
Figure 10:
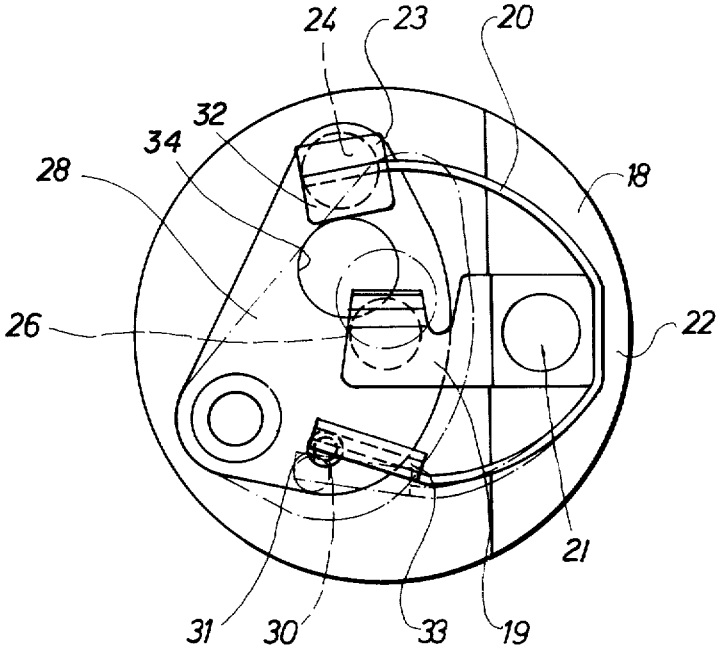

The bottom plate of the third embodiment of the lamp-holder is shown in FIGS. 9 and 10. This bottom plate is comparable to the bottom plate 4, 5, 7, 8, 9 of the embodiment according to FIGS. 1 and 2. The bottom plate comprises a body 18 of insulating material on which central contact shields 19 and a side contact shield 20 are attached by means of a rivet 21. Between the parts 19, 20 is placed an intermediate plate 22 of insulating material, so that as evident from FIG. 9 the two shields are not electrically connected to each other. According to FIG. 10 the side contact shield 20 is provided with two legs, one of which has a part 23 provided to be pressed against a side contact 24 and obtain electrical connection with the same. In the same way the central shield 19 has a part 25 provided to be pressed against a contact 26. The two contacts 24 and 26 are provided with screw clips 27 intended to be connected to the conductors of the cable by means of which the lamp-holder has to be connected to the source of current.

In the same way as by the first and second embodiments the contact parts 23 and 25 of the contact shields 20, 19 respectively, are separated from their respective contacts 24, 26 by means of a plate 28 of insulating material. The plate 28 is pivotable round an extension 29 of the body 18 forming a shaft for the plate 28. The second leg of the side shield 20 (pointing downwards in FIG. 10) is provided with a pin 30 in engagement with the plate 28 by means of a hole 31 in the latter. At the upper boarder of the side shield legs there are wings 32 and 33 provided to rest against the circumference of the lamp-socket when it will be screwed down into the lamp-holder.

The central shield 19 is of resilient conducting material for example bronze and it is formed to be in the position shown in FIG. 9 with the contact part 25 a certain distance from the contact 26. The first leg of the side shield 20 is of the same material and formed in the same way so that the portion 23 is positioned a certain distance from the contact 24. The second leg of the side shield 20 is bent inwards as shown in FIG. 10 and forces the plate 28 by means of the pin 30 and the hole 31 to the position shown in FIG. 10 placed between the parts 23, 25 and their contacts 24, 26.

If the bottom plate according to FIGS. 9, 10 is mounted in a lamp-holder of the form shown in FIGS. 1, 2 and the lamp is screwed down into the lamp-holder, the rounded border of the metal socket on which the thread of the lamp is formed will be pressed against the wings 32 and 33 of the legs of the side shield 20. Thereby the leg with the wing 33 will be pressed outwards as the sloping surface of the wing 33 slides against rounded border of the lamp-socket. As the pin 30 moves outwards the plate 28 will pivot clockwise (in FIG. 10) and the portion of the same placed between the part 23 and the contact 24 will move from this position and at the same time a hole 34 in the plate 28 will be positioned in line with the part 25 of the central shield 19 and its contact 26. The parts and their contacts are consequently free to meet each other when the first leg of the side shield 20 and the central shield 19 are pressed down by the lamp-socket when screwed further down into the lamp-holder. Thereby the shields are connected to the conductors attached to the clips 27.

I claim:

1. Safety device in electrical connection devices, especially lamp sockets, comprising a plurality of contact parts having portions provided to rest against an object arranged to be connected to the connection device, a plurality of contact elements, equal in number to said contact parts, one of said contact parts cooperating with one of said contact elements to form a connection, said contact elements being connected to the electrical leads of a cable, each of said contact parts comprising biasing means for urging said contact parts away from said contact elements, and at least one insulating member mounted between said contact parts and said contact elements for separating all of said contact parts from all of said contact elements when there is no object in said connection device, said insulating member comprising means for moving said insulating member so as to allow said contact parts and elements to contact each other in response to the insertion of an object into said connection device.

2. The safety device according to claim 1, wherein said insulating member comprises a thin plate positioned between said contact parts and said contact elements.

3. The safety device according to claim 2, wherein said plate comprises at least one opening, and said means for moving said insulating member comprises an abutment projecting from one edge of said thin plate so that as said object is inserted into said connection device, the abutment and, therefore, said thin plate are slidably moved to expose said contact elements.

4. The safety device according to claim 2, wherein said thin plate comprises at least one opening for allowing one of said contact parts to connect with a respective contact element, and said means for moving said insulating member comprises an abutment projecting from one side of said thin plate, said thin plate comprising a pivot so that as said object is inserted into said connection device, the abutment and, therefore, the thin plate is pivotally moved to expose said contact elements.

5. The safety device according to claim 1, wherein one of said contact parts comprises a pair of arms, one of said arms mounting a member for contacting a respective one of said contact elements, and the other of said arms comprises a pin for cooperation with said means for moving said insulating member.

6. The safety device according to claim 5, wherein said insulating member comprises a thin plate positioned between said contact parts and said contact elements, and said means for moving said insulating member is an opening in said thin plate for receiving said pin therethrough.

7. The safety device according to claim 6, wherein said thin plate comprises at least one opening for exposing at least one of said contact elements, and a pivot pin, so that upon insertion of said object in said connection device, the object pivots said thin plate via said pin and said means for moving.

* * * * *